United States Patent [19]

Marshall, Jr.

[11] 4,330,119

[45] May 18, 1982

[54] INFLATABLE STRIKING MEMBER

[76] Inventor: LeRoy J. Marshall, Jr., 2519 Union St., Lafayette, Ind. 47904

[21] Appl. No.: 123,299

[22] Filed: Feb. 21, 1980

[51] Int. Cl.[3] ..... A63B 69/00

[52] U.S. Cl. ..... 272/76; 272/DIG. 5

[58] Field of Search ..... 272/76, 78, 77, DIG. 5; 273/55 A, 55 B, 55 R; 73/379, 709, 380, 381, 389, 396

[56] References Cited

U.S. PATENT DOCUMENTS

| | | | |
|---|---|---|---|
| 750,593 | 1/1904 | Cady | 272/76 |
| 1,250,905 | 12/1917 | Liljegran | 272/76 |
| 3,466,930 | 9/1969 | Lemonick | 273/55 R |
| 4,108,428 | 8/1978 | Winterbottom | 272/76 |

*Primary Examiner*—Richard C. Pinkham
*Assistant Examiner*—T. Brown
*Attorney, Agent, or Firm*—Robert A. Spray

[57] ABSTRACT

An exerciser/trainer device, for being struck by the user in exercising or training, which yields a numerical, or other quantitative or qualitative indication, of factors relating to the striking factors, hopefully stimulating and encouraging the user to maximum attainments from the exercise or training. The device is comprised of an inflatable body member surrounding a conduit support member having a plurality of apertures therein, the apertures being in communication with the interior of the inflated member. A pressure/force responsive device is attached to the conduit such that a force applied to the inflatable member will be indicated by the pressure/force responsive device.

2 Claims, 5 Drawing Figures

INFLATABLE STRIKING MEMBER

The present invention provides an advantageous exerciser/trainer means, which when struck by the user in exercising or training, gives a qualitative or quantitative indication of the striking being done.

More particularly, the invention provides a wall member adapted to be struck by the user; and pressure/-force responsive means which are operatively connected to the wall member lead to indicator means, providing by the overall combination, that the striking of the wall member is sensed by the pressure/force responsive means, and that sensing is thereupon indicated by the indicator means, yielding the desired qualitative or quantitative reading or indication as to the striking effort.

Thus the device provides not only the equipment for the exercise or training, but additionally, it provides indicator means which hopefully measures, challenges, provides comparisons, encourages, monitors, stimulates, and otherwise gives incentives and a sort of automatic supervision to the user and to the program and efforts of the exercise and/or training.

Even more particularly, in the embodiment here shown and described for illustration of the inventive concepts, the wall member is in the form of an inflated cylindrical body member, and the supporting frame for it includes a hollow pole having openings in the pole means which cause increases in pressure of the inflated body member, as caused by striking of the inflated body member, to cause corresponding increases in pressure within the hollow interior of the pole; and the pole extends outwardly of the inflated body member and is in communication with the indicator means, thereby causing the indicator means to indicate correspondingly to the effect upon the inflated body member of the striking effort of the exercise or training.

The above is introductory and thus somewhat generalized. More particular details of the features and concepts are set forth in the following more-detailed description of an illustrative embodiment of the invention, reference being had to the accompanying somewhat schematic and diagrammatic drawings, in which.

Figure 1:
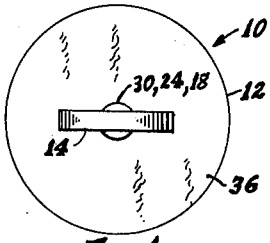
FIG. 1 is a top plan view of the exerciser/trainer means shown in FIG. 2.

In the drawings, certain portions are shown as broken away or in section, as is conventional, for illustrating details otherwise hidden or obscure.

As shown in the drawings, the present invention provides an exerciser/trainer means 10.

In the illustrative embodiment shown in the drawings, a generally cylindrical wall member 12 is adapted to be struck by the user in his or her exercising or training maneuvers.

Operatively connected to the wall member are pressure/force responsive means, and indicator means 14 are operatively connected to the pressure/force responsive means.

The overall attainment of the components is that the striking of the wall member 12 is sensed by the pressure/force responsive means, and that sensing is thereupon indicated by the indicator means 14, yielding whatever numerical or other qualitative or quantitative message or reading is desired, according to the nature of the particular indicator means 14 used.

More particularly in the form shown, the wall member 12 is provided as an inflated body member mounted upon a supporting frame means 16, and there are conduit means 18 which are provided, which operatively interconnect the interior 20 of the inflated body member 12 with the pressure/force responsive means in a manner such that the pressure/force of the striking of the inflated body member 12 is sensed by the pressure/force responsive means.

The pressure/force responsive means (which are referred to in that double-type expression due to the operative similarity of those concepts and their operatively similar manifestations to energize appropriate indicating means operatively connected thereto) are here shown to include several components, the identity of which depends upon which parts are considered part of the indicating means and which parts are considered as intermediate between the bag wall 12 and the ultimate needle or dial pointer 22 of the indicator means or gauge 14, for indeed all the parts in the entire strike-responsiveness are pressure-force responsive, even including the indicator gauge 14.

Thus, rather than arbitrarily specifying more specifically which are the pressure/force responsive means, and which are more related to the indicator means including the gauge 14, the parts and their operativity are now designated and described.

Figure 2:
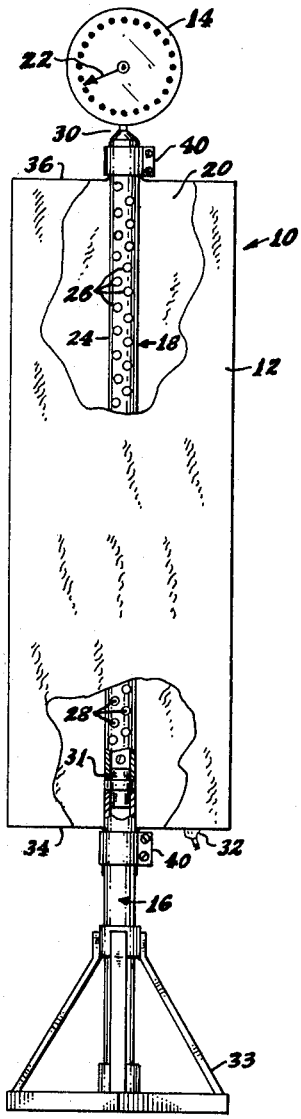
FIG. 2 is an elevation view of an exerciser/trainer means according to an embodiment of the present invention.

Quite apparent from FIG. 2, the inflated bag body 12 is shown supported by a hollow supporting pole 24, and there are openings 26 provided in the pole 24, which cause any increases in pressure of the inflated body member 12, which would be caused by a person striking of the inflated body member 12, to cause corresponding increases in pressure within the hollow interior 28 of the pole means.

The pole 24 extends outwardly of the inflated body member 12, and the hollow interior 28 of the pole 24 connects, through a fitting 30, to the indicator gauge 14 thereby to cause the indicator gauge 14 to indicate correspondingly to the effect, upon the inflated body member 12, of its being struck by the user.

Figure 3:
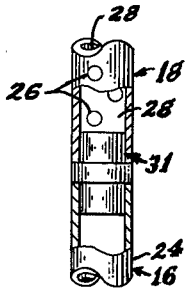
FIG. 3 is an enlarged detail view of a sealing or plugging means adjacent the lower end of the strikable bag member.
Figure 4:
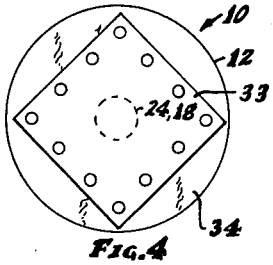
FIG. 4 is a bottom view of the device shown in FIG. 2.

The lower portion of the interior 28 of the pole 24 is suitably plugged or sealed at 31 (FIGS. 2 and 3) to provide air-tightness; and the inflated body member 12 is shown as provided with an inlet valve 32 which may be in the form of an inlet valve for a vehicle tire.

As shown, and the axis of the cylinder 12 is generally coincident with the axis of the pole 24. The pole 24 is shown supported by a base 33.

Providing the desired resilience of a surface to be repeatedly struck in its operativity, the wall member 12 is of a generally rigid nature, although it is yieldable in response to being struck.

Figure 5:
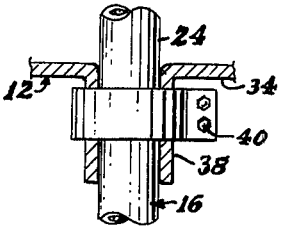
FIG. 5 is an enlarged detail view of means sealing a sleeve-like end of the inflatable bag against the axial supporting pole.

The lower and upper walls 34 and 36 of the inflated body member 12 (as illustrated by wall 34 of FIG. 5) are out-turned to provide an integral sleeve 38 which is clamped in air-tight relation to the pole 24 by cylindrical clamps 40.

For sensing the blows or striking effect upon the inflated bag 12, its flexibility causes or permits its shape or volume to be changed by the wall member 12 being struck; and the change in shape or volume provides the indication of the striking blow to the pressure/force responsive means.

The pressure/force-responsive means and/or the indicator means are a type which can be set to indicate whatever striking factor is desired to be known.

It is thus seen that an exerciser/trainer device or means according to the inventive concepts provides a desired and advantageous device, yielding the high advantage of a strikable device which also provides a quantitative and/or qualitative measurement or indication as to the effort of the training or exercise.

Accordingly, it will thus be seen from the foregoing description of the invention according to this illustrative embodiment, considered with the accompanying drawings, that the present invention provides new and useful concepts of an exerciser/trainer device or means, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. An exerciser/trainer means, comprising, in combination:

a wall member adapted to be struck by the user;

pressure/force responsive means operatively connected to the wall member;

indicator means operatively connected to the pressure/force responsive means;

the parts being arranged and adapted such that the striking of the wall member is sensed by the pressure/force responsive means, and that sensing is thereupon indicated by the indicator means;

in which the wall member is provided as an inflated body member mounted upon a supporting frame means, and conduit means are provided which operatively interconnect the interior of the inflated body member with the pressure/force responsive means in a manner such that the pressure/force of the striking of the inflated body member is sensed by the pressure/force responsive means;

in a combination in which the supporting frame means includes a hollow pole, opening means being provided in the pole means which cause any increases in pressure of the inflated body member, which are caused in striking of the inflated body member, to cause corresponding increases in pressure within the hollow interior of the pole means, the pole means extending outwardly of the inflated body member and the hollow interior of the pole communicating with the pressure/force responsive means, thereby to cause the indicator means to indicate correspondingly to the effect upon the inflated body member of its being struck.

2. The invention as set forth in claim 1 in which the inflated body member is provided in the general shape of a cylinder, and the axis of the cylinder is generally coincident with the axis of the pole means.

* * * * *